US010132590B2

(12) United States Patent
Leven et al.

(10) Patent No.: US 10,132,590 B2
(45) Date of Patent: Nov. 20, 2018

(54) ARCHERY VIBRATION DAMPER

(71) Applicant: Leven Industries, Inc., Lancaster, CA (US)

(72) Inventors: William L. Leven, Lancaster, CA (US); Erick J. Hall, Lancaster, CA (US)

(73) Assignee: LEVEN INDUSTRIES, INC., Lancaster, CA (US)

( * ) Notice: Subject to any disclaimer, the term of this patent is extended or adjusted under 35 U.S.C. 154(b) by 0 days.

(21) Appl. No.: 15/804,831

(22) Filed: Nov. 6, 2017

(65) Prior Publication Data

US 2018/0172389 A1 Jun. 21, 2018

Related U.S. Application Data

(60) Provisional application No. 62/437,041, filed on Dec. 20, 2016.

(51) Int. Cl.
*F41B 5/20* (2006.01)
*F41B 5/14* (2006.01)

(52) U.S. Cl.
CPC ..... *F41B 5/1426* (2013.01)

(58) Field of Classification Search
CPC ..... F41B 5/1426
See application file for complete search history.

(56) References Cited

U.S. PATENT DOCUMENTS 3,628,520 A * 12/1971 Izuta ..... F41B 5/1426 124/23.1
4,615,327 A * 10/1986 Saunders ..... F41B 5/1426 124/89
5,975,070 A * 11/1999 Sands ..... F41B 5/1426 124/89
6,021,770 A * 2/2000 Sodaro ..... F41B 5/1426 124/86
6,076,514 A * 6/2000 Adams, Jr. ..... F41B 5/1426 124/89
6,186,135 B1 * 2/2001 Harwath ..... F41B 5/1426 124/89

* cited by examiner

*Primary Examiner* — John Ricci
(74) *Attorney, Agent, or Firm* — DLA Piper LLP (US)

(57) ABSTRACT

Systems described here include assemblies used for damping vibration. Some embodiments include an exo-skeleton with two openings, two inner cores mounted inside the exo-skeleton, two independent fasteners, each with an attachment end and a flange end. In some embodiments, the two independent fastener flange ends are mounted inside the exo-skeleton, each in one of the inner cores, and the two independent fastener attachment ends extending out of their respective opening of the exo-skeleton.

8 Claims, 6 Drawing Sheets

ARCHERY VIBRATION DAMPER

CROSS REFERENCE

This application hereby incorporates by reference U.S. Pat. No. 9,016,268 and U.S. Pat. No. 5,273,022.

TECHNICAL FIELD

This application relates to the field of mechanical weights and vibration dampers, devices for limiting and absorbing mechanical vibration, particularly devices utilized in conjunction with archery bows.

BACKGROUND

In archery, it is sometimes useful to have a vibration damper which is attached to an archery bow. Such a vibration damper may reduce shock and vibration that is felt by the user of an archery bow after release. Older model vibration dampers were single piece construction units with no ability to customize or integrate different component parts.

SUMMARY

Systems here include assembly embodiments for damping vibration, including an exo-skeleton with two openings, two inner cores, configured to mount inside the exo-skeleton, two independent fasteners, each with an attachment end and a flange end, wherein the two independent fastener flange ends are mounted inside the exo-skeleton, each in one of the inner cores, and the two independent fastener attachment ends extending out of their respective opening of the exo-skeleton. In some embodiments, the exo-skeleton is made of two pieces.

In some embodiments the exo-skeleton includes internal pillars configured to hold the two inner cores in place. In some examples, the two inner cores are made of different material.

Alternatively or a5itionally, in some embodiments, each of the two inner cores have different durometers. In some examples, two independent fasteners are configured to mount inside the two inner cores and remain separated. In some embodiments, the two pieces of the exo-skeleton are held together by bolts.

BRIEF DESCRIPTION OF THE DRAWINGS

For a better understanding of the embodiments described in this application, reference should be made to the Detailed Description below, in conjunction with the following drawings in which like reference numerals refer to corresponding parts throughout the figures.

DETAILED DESCRIPTION

Reference will now be made in detail to embodiments, examples of which are illustrated in the accompanying drawings. In the following detailed description, numerous specific details are set forth in order to provide a sufficient understanding of the subject matter presented herein. But it will be apparent to one of ordinary skill in the art that the subject matter may be practiced without these specific details. Moreover, the particular embodiments described herein are provided by way of example and should not be used to limit the scope of the invention to these particular embodiments. In other instances, well-known data structures, timing protocols, procedures, and components have not been described in detail so as not to unnecessarily obscure aspects of the embodiments of the invention.

Overview

Figure 1:
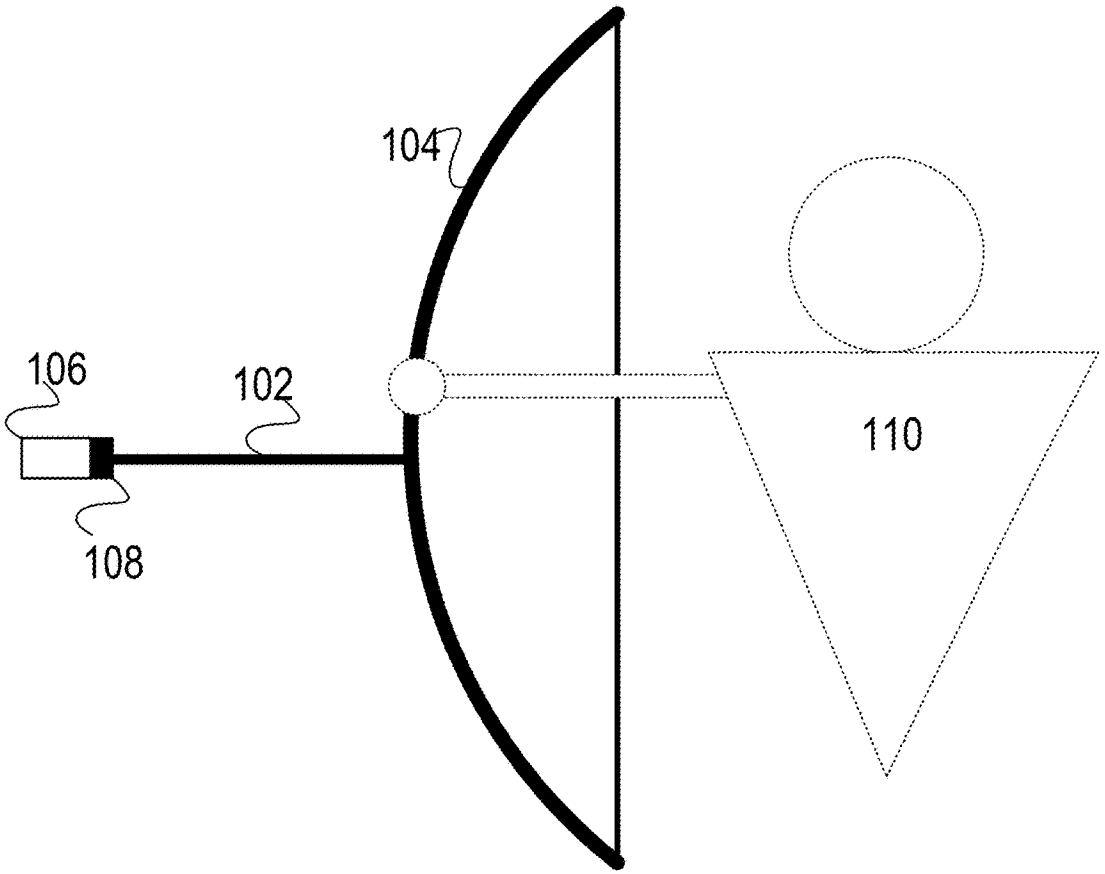
FIG. 1 is a drawing showing example overview according to certain embodiments disclosed here.

Archery bows may be outfitted with various devices which can enhance the archer's ability to aim precisely. One such device is known as a stabilizer. FIG. 1 shows a simplistic example of a stabilizer 102 attached to an archery bow 104 in the hands of an archer 110. The stabilizer 102 includes a weighted object 106 that is affixed to the bow 104 itself. Such a weight 106 attachment that is strategically placed, may move the center of gravity of the bow to an advantageous position as well as make the farthest end of the bow 104 heavy. Such weight 106 may allow an archer 110 to more precisely aim. Such vibration damper may also aid in silencing or quieting the bowstring release.

In certain embodiments, a vibration damper 108 is affixed somewhere between on the stabilizer 102 in order to absorb vibration during a bowstring release. In some embodiments, such a vibration damper 108 is positioned close to the end of the stabilizer 102, where the weighted portion 106 is located.

Such a vibration damper 108 may be affixed to the stabilizer 102 and weight 106 though any of various ways including but not limited to threaded screw, magnetic, snap, lock or other ways. In such a way, a vibration damper can be removed, changed, color coordinated, or otherwise customized for the archer 110 in whatever situation is presented.

It should be noted that any arrangement of the weight 106, stabilizer 102 and the vibration damper 108 may be made. The example shown in FIG. 1 with the damper 108 next to the weight 106 is not intended to be limiting. The damper 108 could be affixed to the bow itself 104, or between segments of the stabilizer 102. Further, in some embodiments, multiple dampers 108 could be used. In some examples, multiple weights 106 could be used. In some examples, multiple stabilizers 102 could be used. Any combination of the above or other arrangements could be utilized with the component vibration damper 108 disclosed here.

Figure 2:
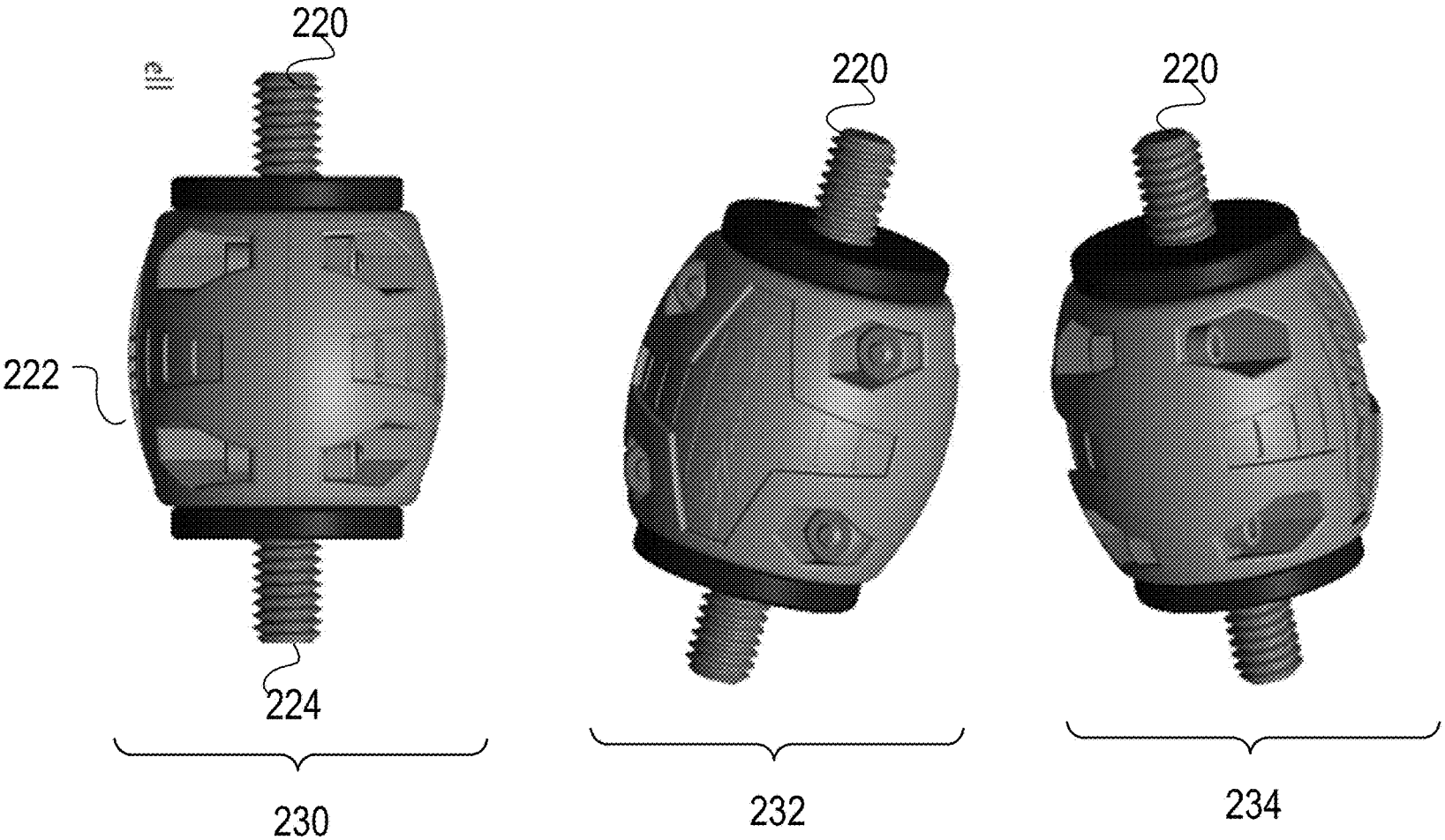
FIG. 2 is a drawing showing example exterior embodiments according to certain embodiments disclosed here.

FIG. 2 shows three different example views 230, 232, 234 of one such example vibration damper which is described in detail here. As can be seen in FIG. 2, the vibration damper includes a main body 222 which may be a hollow shell with internally mounted attachments 220, 224. These attachments 220, 224 are used to attach the damper to the weight and/or the stabilizer and/or the bow, or other part. The example shows threaded screw-type attachments 220, 224.

Vibration Damper Component Parts

In some embodiments, the vibration damper is made of different component parts that combine to produce the desired effects for the archer.

Figure 3:
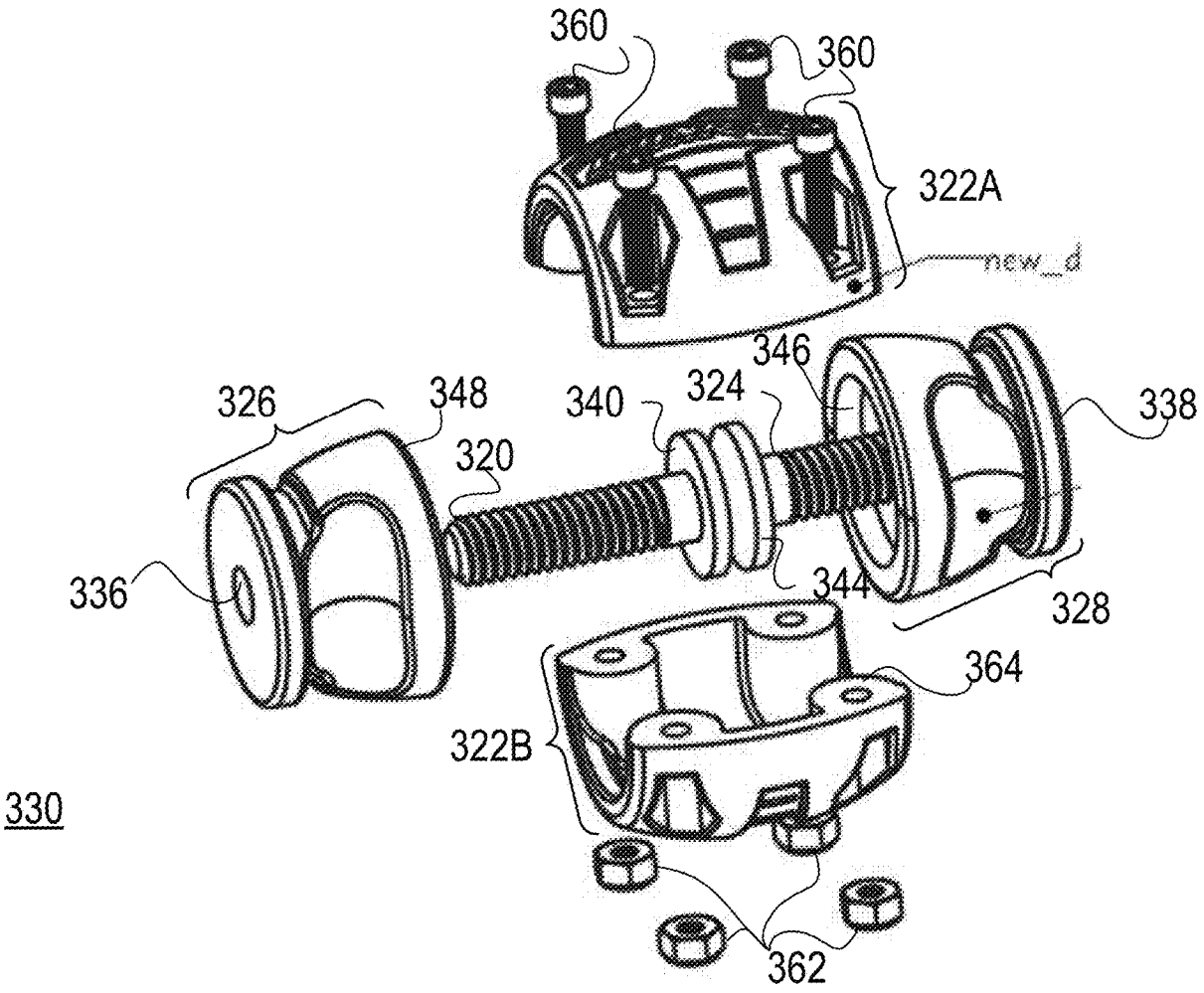
FIG. 3 is a drawing showing example exploded view embodiments according to certain embodiments disclosed here.

FIG. 3 shows an exploded view of one such vibration damper. 330 The example shows the exo-skeleton shell in two parts 322A and 322B. The example of two parts is merely exemplary and the exo-skeleton shell could be made of more than two parts in other example embodiments. The exo-skeleton shell is discussed in more detail below.

Fasteners/Attachments

FIG. 3 also shows the two attachments or fasteners 320, 324. As can be seen, the example shows threaded screw-type attachments. It should be noted that the attachments or fasteners 320, 324 may be male or female attachments, threaded screw type or other kind of attachment. As described here, they may be removed and changed out for attachments or fasteners that suit the need of the archer.

The two attachments 320, 324 in FIG. 3 are separate and independent of one another. Each includes a flange or flat end 340, 344 in the examples, but these flat ends 340, 344 are merely used as an example. The two attachments 320 and 324 could have ends that are bulbous, square, crossed, tapered, or otherwise shaped at the end not used to attach to either the weight, bow, or stabilizer as described above. These ends 340, 344 may prevent the attachments 320, 324 from being pulled out of the system by interacting with each respective core 326, 328 as described herein.

It should be noted that the inner core sections 326, 328 may be of sufficient length to allow the flange or flat end 340, 344 of the fastener 320, 324 to move and not come in contact when flexing of the opposing fastener. Further, in some embodiments, the fastener 320, 324 and accompanying flange 340, 344 is of a diameter that may interact with the exo-skeleton shell internal structures or pillars 364. In such a way, the fastener or attachments 320, 324 may not be pulled out of the fastened assembly 330.

Inner Cores

FIG. 3 also depicts the two inner cores 326, 328. In some embodiments, these inner cores 326, 328 are also separate component parts and also act independent of one another. As independent parts, they can oscillate at different frequencies in relation to the amount of weight at the distal or proximal ends of the system and the shore hardens of each independent piece. Thus, the two opposing movements may break up the main frequency of the stabilizer rod and stop its vibration.

In some embodiments, the two inner cores do not physically touch each other when assembled in the exo-skeleton shell 322A, 322B. The shape of the two inner cores 326, 328 could be any of various shapes that fit inside the exo-skeleton shell 322A, 322B. In the example of FIG. 3, the inner cores 326, 328 are generally semi-spherically shaped with a hole 336 (obscured 338) running through it for the attachment 320, 324 to fit into and protrude beyond. In some example embodiments, the inner cores 326, 328, include a recessed shape 346 which is designed to fit the shape of the flat end 344 of the attachment 324. In such an arrangement, when assembled, the two attachments 320, 324 fit through the holes 336 (obscured 338) in the inner cores 326, 328 and the flat ends 340, 344 fit into the recesses 346, (obscured 348). The inner core holes 336, 338 may have any sized diameter to allow an assortment of fasteners to be installed, such as for example, a male—male, female—female, or male—female coupling.

In some examples, each core 326, 328 may be made of the same or different material, such as but not limited to elastomeric plastic, rubber, foam, polystyrene. In some examples, the different material may be of different shore hardness, flexibility, weight, material, or other attribute for the particular application of the archer using it. The two cores 326, 328, maybe independently flexible of the other and manufactured in varying durometers and or materials depending on the application. In some examples the two cores 326, 328, may be the same material and/or the same durometer, depending on the application.

In one example, a system with inner cores 326, 328 that have different harnesses may be used to attach to one of the weighted end, the bow and/or the stabilizer. In another example an archer might want to have a 60 shore A hardness core at the base and a 40 shore A hardness core at the weighted end for more flex. The separate inner cores 326, 328 may be made of a soft vibration absorbing material with a hardness of 40-90 durometer A shore.

It should be noted that various third inner core components could be added to the system such as a washer of material configured between the two inner cores 326, 328 that is the same or different material, durometer, flexibility, etc.

Exo-Skeleton Casing

FIG. 3 also shows the outer exo-skeleton shell casing 322A, 322B. The exo-skeleton in the example is generally barrel-shaped with openings at each end. Such an exo-skeleton could be made of any kind of rigid material that is hard, protective, and not prone to breaking. Examples include but are not limited to polymers, high density plastic, carbon fibers, ceramics, stone, metal such as aluminum, or other rigid material. Example outer exo-skeleton casing 322A, 322B, may be made of lightweight material, yet strong and structurally sound.

FIG. 3 also shows the outer shell, or exo-skeleton, or casing as being made of two component parts 322A and 322B. In the example, the two pieces may be held together by fasteners that hold the two external housing shell pieces together while giving support for the elastomeric internal oscillating sections 326, 328. In the example of FIG. 3, the fasteners are bolts 360 which may be attached by nuts 362. Any of other kinds of various fasteners could be used for example, snaps, wingnuts, clamps, springs, or other kind of devices could be used to hold the parts of the exo-skeleton 322A, 322B together. The example of bolts 360 and nuts 362 is merely exemplary. Further, it should be noted that the arrangement of four fasteners 360, 362 is not intended to be limiting. Any number of fasteners could be used to secure the exo-skeleton 322A, 322B together.

In some example embodiments, the exo-skeleton parts 322A, 322B may be hinged by a living hinge, a separate hinge mechanism attached to each piece, or a tab and slot type hinge. In such hinged examples, the exo-skeleton 322A, 322B may only require one or two fasteners on the non-hinged side of the exo-skeleton to hold the entire system together. Such arrangements may allow for quicker disassembly and assembly.

In some example embodiments, the exo-skeleton casing shell 322A, 322B may include internal structures such as pillars 364, cage, spikes or other structures that may hold the inner cores 326, 328 and prevent them from pulling out and/or rotating in the fastened and assembled exo-skeleton shell 322A, 322B.

Assembled System

Figure 4:
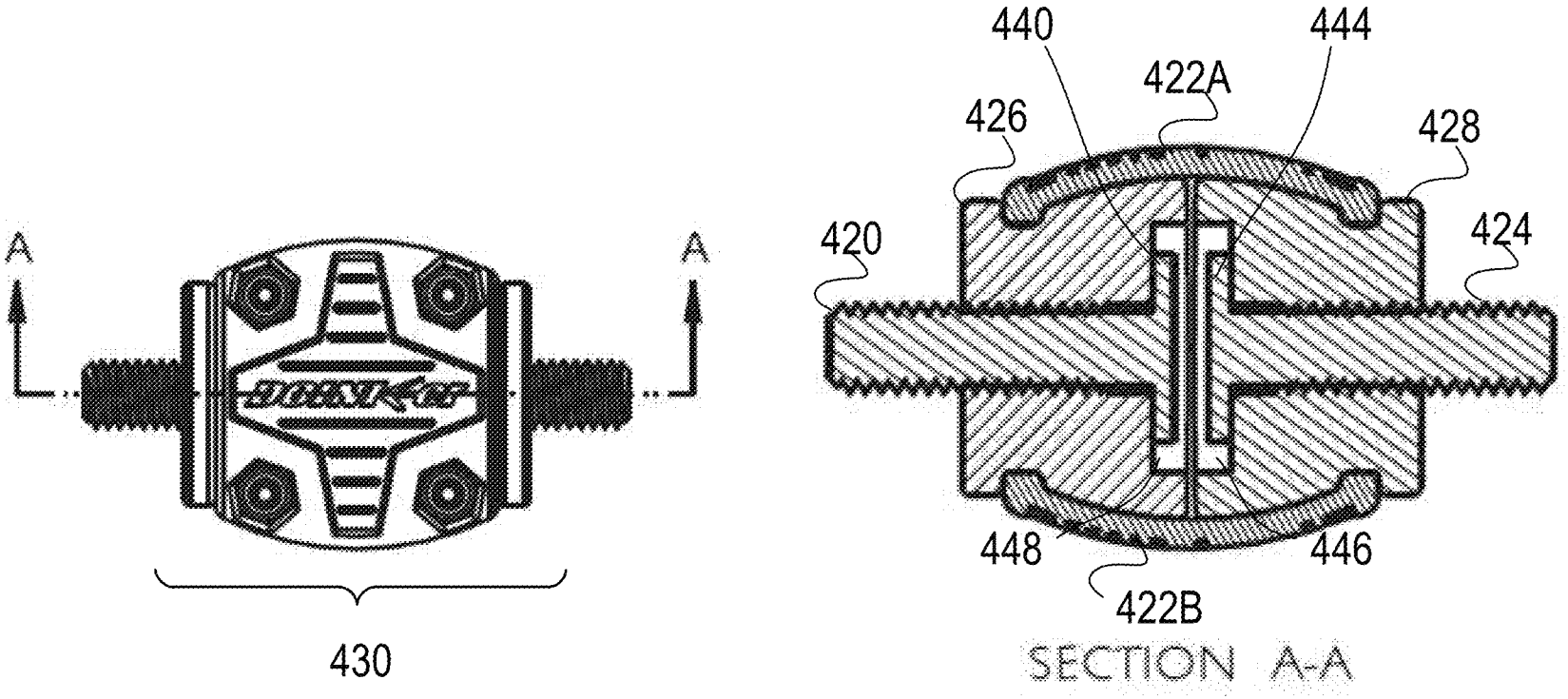
FIG. 4 is a drawing showing example cut away view embodiments according to certain embodiments disclosed here.

FIG. 4 shows a cut away view of the assembled system 430. The example shows the same parts as described here including the two separate attachments 420, 424, as well as the flat ends of the attachments 440, 444.

FIG. 4 also shows a cut away of the exo-skeleton 422A, 422B, as well as the two separate inner cores 426, 428 with their associated recesses 448, 446 which allow for the attachment flat ends 448, 446 to be separated from one another.

Figure 5:
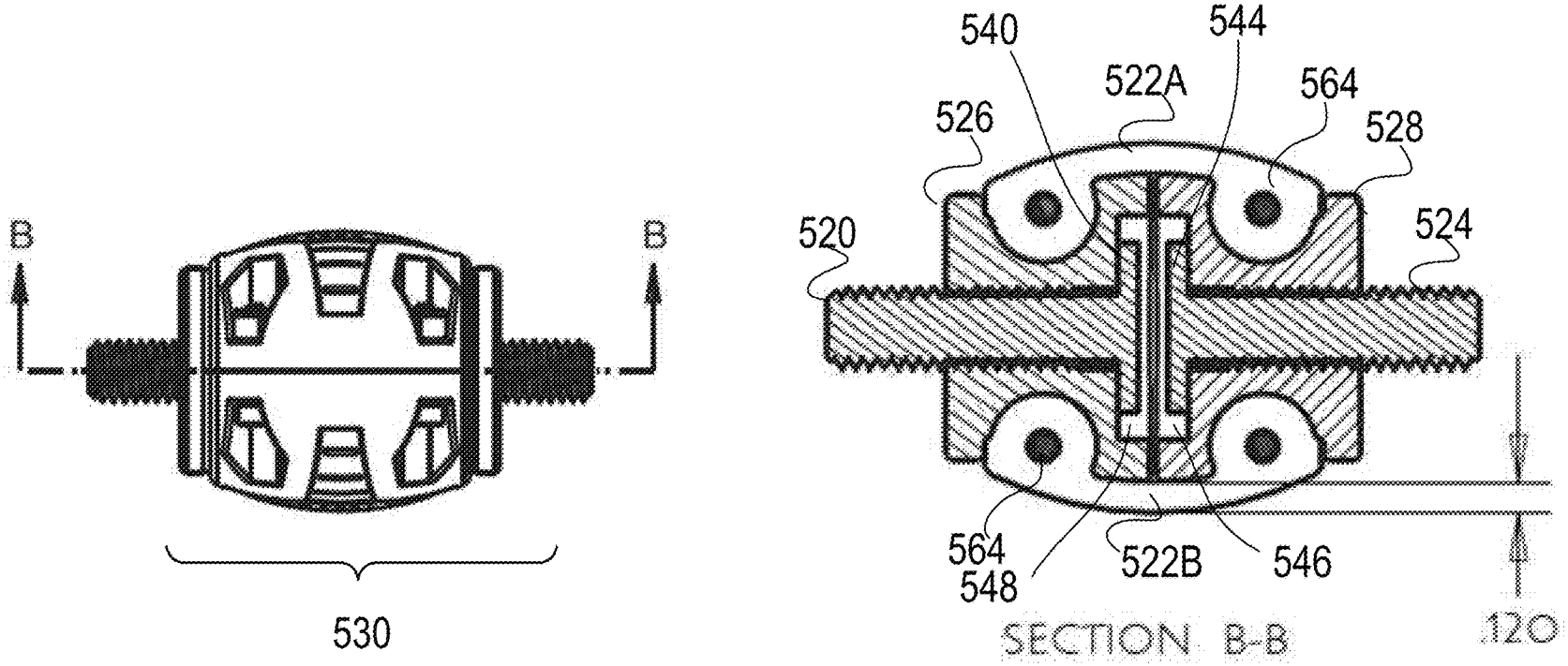
FIG. 5 is a drawing showing more example cut away view embodiments according to certain embodiments disclosed here.

FIG. 5 shows another cut away view of the assembled system 530. Again, the same parts as described here including the two separate attachments 520, 524, as well as the flat ends of the attachments 540, 544. FIG. 5 also shows a cut away of the exo-skeleton 522A, 522B, as well as the two separate inner cores 526, 528 with their associated recesses 548, 546 which allow for the attachment flat ends 548, 546 to be separated from one another. FIG. 5 also shows the example inner column structures 564 made of up parts of the exo-skeleton 522A, 522B. These internal structures 564 restrict movement of the inner cores 526, 528 including twisting, pulling, torque, flex, or other movement which may result during operation.

It should be noted that the size of the entire system could be any of various sizes. The length of the assembled system may be one inch long, two inches long, three inches long or other size. The respective component parts may then be respectively sized accordingly. For example, the body of the system may be 1.625 inches long and the width 1.45 inches. For example, the side walls of the exo-skeleton may be 0.12 inches thick as shown in FIG. 5. Other sizes could be used, this being merely an example. Different component parts may also be weighted differently. In some examples, heavy parts such as metals may be used to create a heavy overall assembled system 530. In some examples, a very light overall system 530 may require light weight yet sturdy polymers to be used to make the exo-skeleton 522A, 522B.

Figure 6:
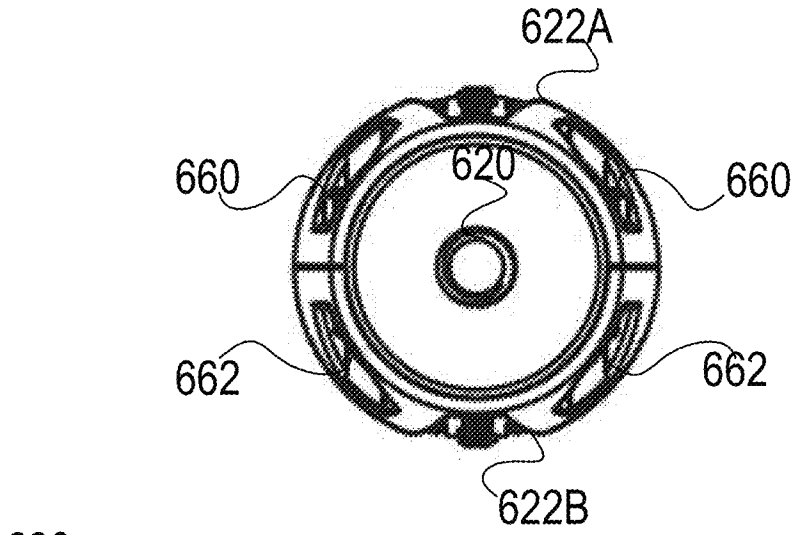
FIG. 6 is a drawing showing example end-on exterior view embodiments according to certain embodiments disclosed here.

FIG. 6 shows an example end-on view of the assembled system 630. As can be seen from the end-on view, the fastener/attachment 620 appears as a circle as it is a threaded bolt in the example. The exo-skeleton parts 622A, 622B are attached by the threaded bolts 660 and nuts 662.

Customization

Referring again to FIG. 2, and as described in detail here, the system 230 may be disassembled and different parts may be changed out. This can allow for a multitude of customizations to be made to the inner and outer parts of the system 230. For example, the assembled system 230, when attached to a stabilizer at a proximal fastened end 224 may be made of material as described herein that can flex or not flex in accordance with the customized durometer of its attached internal body section(s) (obscured). Likewise, and as described below, the system 230 may be able to flex the proximal end 224 mounted near the bow the same amount as the distal section 220 attached to the weight, or in some embodiments, flex differently than the distal section 220 depending on the chosen durometer of the internal inner body pieces described below.

The systems described here, of component parts making up a complete assembly may have many various advantages. This systems described here, thus allow for total control of the type of flexibility provided by the system 230, as well as the attachment makeup such as male or female and the type of thread either inch or metric without the manufacturing of a specific molded fastener. The system can use any male or female insert of appropriate size without the purchase of new elastomer internals. Further, such a customizable system may allow for variously colored component parts may be used. Manufacturing cost may be reduced because parts may be individually manufactured, reducing labor cost and the use of volatile chemicals used in the bonding process. Sales may be made of component parts for customization and upselling as well as appeal to different fashion or hunting requirements such as particular camouflage for a particular environment, or safety colors such as blaze orange, or other color.

CONCLUSION

The foregoing description, for purpose of explanation, has been described with reference to specific embodiments. However, the illustrative discussions above are not intended to be exhaustive or to limit the embodiments to the precise forms disclosed. Many modifications and variations are possible in view of the above teachings. The embodiments were chosen and described in order to best explain the principles of the embodiments and its practical applications, to thereby enable others skilled in the art to best utilize the various embodiments with various modifications as are suited to the particular use contemplated.

Unless the context clearly requires otherwise, throughout the description, the words "comprise," "comprising," and the like are to be construed in an inclusive sense as opposed to an exclusive or exhaustive sense; that is to say, in a sense of "including, but not limited to." Words using the singular or plural number also include the plural or singular number respectively. A5itionally, the words "herein," "hereunder," "above," "below," and words of similar import refer to this application as a whole and not to any particular portions of this application. When the word "or" is used in reference to a list of two or more items, that word covers all of the following interpretations of the word: any of the items in the list, all of the items in the list and any combination of the items in the list.

Although some presently preferred implementations of the embodiments have been specifically described herein, it will be apparent to those skilled in the art to which the embodiments pertains that variations and modifications of the various implementations shown and described herein may be made without departing from the spirit and scope of the embodiments. Accordingly, it is intended that the embodiments be limited only to the extent required by the applicable rules of law.

What is claimed is:

1. A system for damping vibration, comprising:

an exo-skeleton with two openings;

two inner cores mounted inside the exo-skeleton;

two independent fasteners, each with an attachment end and a flange end, wherein the two independent fastener flange ends are mounted inside the exo-skeleton, each in one of the inner cores, and the two independent fastener attachment ends extending out of their respective opening of the exo-skeleton, wherein the exo-skeleton includes internal pillars configured to hold the two inner cores in place.

2. A system for damping vibration, comprising:

an exo-skeleton with two openings;

two inner cores mounted inside the exo-skeleton;

two independent fasteners, each with an attachment end and a flange end, wherein the two independent fastener flange ends are mounted inside the exo-skeleton, each in one of the inner cores, and the two independent fastener attachment ends extending out of their respective opening of the exo-skeleton, wherein each of the two inner cores are made of different material.

3. A system for damping vibration, comprising:
an exo-skeleton with two openings;
two inner cores mounted inside the exo-skeleton;
two independent fasteners, each with an attachment end and a flange end,
wherein the two independent fastener flange ends are mounted inside the exo-skeleton, each in one of the inner cores, and the two independent fastener attachment ends extending out of their respective opening of the exo-skeleton,
wherein each of the two inner cores have different durometers.

4. A system for damping vibration, comprising:
an exo-skeleton with two openings;
two inner cores mounted inside the exo-skeleton;
two independent fasteners, each with an attachment end and a flange end,
wherein the two independent fastener flange ends are mounted inside the exo-skeleton, each in one of the inner cores, and the two independent fastener attachment ends extending out of their respective opening of the exo-skeleton,
wherein the exo-skeleton is made of two pieces,
wherein the two pieces of the exo-skeleton are held together by bolts.

5. A system for damping vibration, comprising:
a two-piece exo-skeleton forming an internal cavity;
two inner cores mounted inside the exo-skeleton cavity;
two independent fasteners, each with an attachment end and a flat end,
wherein the two independent fastener flat ends are mounted inside the exo-skeleton cavity, each in one of the inner cores,
wherein the wherein the exo-skeleton includes internal pillars configured to hold the two inner cores in place.

6. A system for damping vibration, comprising:
a two-piece exo-skeleton forming an internal cavity;
two inner cores mounted inside the exo-skeleton cavity;
two independent fasteners, each with an attachment end and a flat end,
wherein the two independent fastener flat ends are mounted inside the exo-skeleton cavity, each in one of the inner cores
wherein each of the two inner cores have different durometers.

7. A system for damping vibration, comprising:
a two-piece exo-skeleton forming an internal cavity;
two inner cores mounted inside the exo-skeleton cavity;
two independent fasteners, each with an attachment end and a flat end,
wherein the two independent fastener flat ends are mounted inside the exo-skeleton cavity, each in one of the inner cores,
wherein the wherein the exo-skeleton pieces each includes internal pillars configured to hold the two inner cores in place.

8. A system for damping vibration, comprising:
a two-piece exo-skeleton forming an internal cavity;
two inner cores mounted inside the exo-skeleton cavity;
two independent fasteners, each with an attachment end and a flat end,
wherein the two independent fastener flat ends are mounted inside the exo-skeleton cavity, each in one of the inner cores
wherein the two pieces of the exo-skeleton are held together by at least two bolts and two nuts.

* * * * *